US010364776B2

(12) United States Patent
Teramoto

(10) Patent No.: US 10,364,776 B2
(45) Date of Patent: Jul. 30, 2019

(54) AIR INTAKE APPARATUS

(71) Applicant: AISIN SEIKI KABUSHIKI KAISHA, Kariya-shi, Aichi-ken (JP)

(72) Inventor: Hideaki Teramoto, Kariya (JP)

(73) Assignee: AISIN SEIKI KABUSHIKI KAISHA, Kariya-Shi, Aichi (JP)

( * ) Notice: Subject to any disclaimer, the term of this patent is extended or adjusted under 35 U.S.C. 154(b) by 37 days.

(21) Appl. No.: 15/513,675

(22) PCT Filed: Sep. 25, 2015

(86) PCT No.: PCT/JP2015/077065
§ 371 (c)(1),
(2) Date: Mar. 23, 2017

(87) PCT Pub. No.: WO2016/059955
PCT Pub. Date: Apr. 21, 2016

(65) Prior Publication Data

US 2017/0306895 A1 Oct. 26, 2017

(30) Foreign Application Priority Data

Oct. 17, 2014 (JP) ..... 2014-212287

(51) Int. Cl.
*F02M 26/20* (2016.01)
*F02M 35/104* (2006.01)
(Continued)

(52) U.S. Cl.
CPC ..... *F02M 26/20* (2016.02); *F02M 26/17* (2016.02); *F02M 26/19* (2016.02); *F02M 35/104* (2013.01); *F02M 35/10222* (2013.01)

(58) Field of Classification Search
CPC ..... F02M 26/13; F02M 26/17; F02M 26/19; F02M 26/20; F02M 26/21; F02M 26/41; F02M 35/10222; F02M 35/104
See application file for complete search history.

(56) References Cited

U.S. PATENT DOCUMENTS 7,198,040 B2 * 4/2007 Noda ..... F02M 25/06 123/568.15
7,270,102 B2 * 9/2007 Tanikawa ..... B29C 65/06 123/184.42
(Continued)

FOREIGN PATENT DOCUMENTS

EP 1 122 421 A2 8/2001
EP 1 801 382 A2 6/2007
(Continued)

OTHER PUBLICATIONS

Akima, JP 4493890, Jun. 30, 2010, machine translation.*
(Continued)

*Primary Examiner* — Hung Q Nguyen
*Assistant Examiner* — Mark L. Greene
(74) *Attorney, Agent, or Firm* — Buchanan Ingersoll & Rooney PC

(57) ABSTRACT

This air intake apparatus includes an air intake apparatus body including an intake air passage and an external gas passage portion provided as a structure separate from the air intake apparatus body inside the air intake apparatus body, the external gas passage portion through which external gas can be introduced into the intake air passage.

4 Claims, 4 Drawing Sheets

(51) Int. Cl.

| | |
|---|---|
| ***F02M 26/17*** | (2016.01) |
| ***F02M 26/19*** | (2016.01) |
| ***F02M 35/10*** | (2006.01) |

(56) References Cited

U.S. PATENT DOCUMENTS

| | | | | |
|---|---|---|---|---|
| 8,037,859 | B2 * | 10/2011 | Kameda | F02M 35/10144 123/184.21 |
| 8,511,289 | B2 * | 8/2013 | Tanikawa | F02M 35/10039 123/184.42 |
| 2001/0025632 | A1 | 10/2001 | Pietrowski et al. | |
| 2005/0039730 | A1 * | 2/2005 | Nishida | F02M 35/10085 123/568.17 |
| 2006/0060163 | A1 | 3/2006 | Vanderveen et al. | |
| 2006/0191505 | A1 | 8/2006 | Doko et al. | |
| 2011/0120430 | A1 * | 5/2011 | Marimbordes | F02M 35/10052 123/568.12 |
| 2014/0014056 | A1 | 1/2014 | Sato | |
| 2017/0284348 | A1 * | 10/2017 | Teramoto | F02M 35/112 |

FOREIGN PATENT DOCUMENTS

| | | | |
|---|---|---|---|
| FR | 2 879 262 | A1 | 6/2006 |
| JP | 3-110163 | U | 11/1991 |
| JP | 2003-097369 | A | 4/2003 |
| JP | 2004-044558 | A | 2/2004 |
| JP | 2013-113139 | A | 6/2010 |
| JP | 4493890 | B2 * | 6/2010 |
| JP | 2011-080394 | A | 1/2011 |
| JP | 2014-040801 | A | 3/2014 |
| JP | 2014-173578 | A | 9/2014 |

OTHER PUBLICATIONS

Extended European Search Report dated Jul. 19, 2017, by the European Patent Office in corresponding European Application No. 15850617.0-1616. (6 pages).

International Search Report (PCT/ISA/210) dated Dec. 22, 2015, by the Japanese Patent Office as the International Searching Authority for International Application No. PCT/JP2015/077065.

Written Opinion (PCT/ISA/237) dated Dec. 22, 2015, by the Japanese Patent Office as the International Searching Authority for International Application No. PCT/JP2015/077065.

* cited by examiner

CROSS-SECTION TAKEN ALONG LINE 170-170

CROSS-SECTION TAKEN ALONG LINE 180-180

AIR INTAKE APPARATUS

TECHNICAL FIELD

The present invention relates to an air intake apparatus, and more particularly, it relates to an air intake apparatus configured such that external gas can be introduced into an intake air passage.

BACKGROUND ART

In general, an air intake apparatus configured such that external gas can be introduced into an intake air passage is known. Such an air intake apparatus is disclosed in Japanese Patent Laying-Open No. 2011-80394, for example.

In Japanese Patent Laying-Open No. 2011-80394, there is disclosed an air intake apparatus for a multi-cylinder (four-cylinder) engine configured such that exhaust gas (EGR gas) of the engine can be partially introduced into an intake air passage. This air intake apparatus for a multi-cylinder engine described in Japanese Patent Laying-Open No. 2011-80394 includes an air intake apparatus body formed by integrating a surge tank and four air intake pipes connected to the surge tank. An EGR gas recirculation path (external gas passage) for introducing the EGR gas (external gas) is integrally formed on an air intake pipe member along the outer wall surface of the air intake apparatus body. Therefore, the EGR gas flows through the EGR gas recirculation path arranged on the outer wall surface of the air intake apparatus body, is branched into four, and thereafter is introduced (supplied) into the air intake pipes through inlets that pass through the outer wall and are communicated with the air intake pipes.

PRIOR ART

Patent Document

Patent Document 1: Japanese Patent Laying-Open No. 2011-80394

SUMMARY OF THE INVENTION

Problem to be Solved by the Invention

In the air intake apparatus for a multi-cylinder engine described in Japanese Patent Laying-Open No. 2011-80394, however, the EGR gas recirculation path is arranged on the outer wall surface side of the air intake apparatus body, and hence the EGR gas recirculation path is directly influenced by outside air temperature. Particularly when the engine is operated under conditions of low outside air temperature (below freezing) and the EGR gas is introduced, the EGR gas recirculation path is directly cooled by low-temperature outside air. In addition, the EGR gas recirculation path is indirectly cooled by the air intake apparatus body cooled by low-temperature intake air. Thus, moisture contained in the EGR gas is easily condensed in the vicinity of the cooled inner wall surface of the EGR gas recirculation path due to a difference in temperature between the cooled inner wall surface and the warm EGR gas discharged from the engine. Furthermore, when the generated condensed water is drawn into a cylinder by negative pressure, accidental fire occurs in a combustion chamber. In addition, a deposit caused by the condensed water is easily generated in the EGR gas recirculation path. For this reason, although the EGR gas is introduced in order to increase engine performance (fuel economy) by reducing a pumping loss (intake and exhaust loss), there is such a problem that engine quality is reduced due to occurrence of accidental fire in the cylinder or generation of a deposit.

The present invention has been proposed in order to solve the aforementioned problem, and an object of the present invention is to provide an air intake apparatus capable of increasing engine performance (fuel economy) while suppressing a reduction in engine quality.

Means for Solving the Problem

In order to attain the aforementioned object, an air intake apparatus according to an aspect of the present invention includes an air intake apparatus body including an intake air passage, and an external gas passage portion provided as a structure separate from the air intake apparatus body inside the air intake apparatus body, the external gas passage portion through which external gas can be introduced into the intake air passage.

As hereinabove described, the air intake apparatus according to this aspect of the present invention includes the external gas passage portion provided as the structure separate from the air intake apparatus body inside the air intake apparatus body, the external gas passage portion through which the external gas can be introduced into the intake air passage. Thus, the external gas passage portion is included in (built into) the air intake apparatus body in a state where the external gas passage portion is a separate member from the air intake apparatus body, and hence the external gas that flows through the external gas passage portion is inhibited by both the external gas passage portion and the air intake apparatus body outside the external gas passage portion from being directly influenced by outside air (outside air temperature). Therefore, even when an engine is operated under conditions of low outside air temperature (below freezing), the heat retaining property of the external gas passage portion is increased, and hence cooling of the warm external gas in the external gas passage portion is suppressed. In other words, moisture or the like contained in exhaust gas recirculation gas recirculated to the engine or blow-by gas (unburned gas mixture) for ventilating a crank chamber can be inhibited from being cooled and condensed in the external gas passage portion, and hence occurrence of accidental fire in a combustion chamber can be suppressed. Furthermore, generation of a deposit caused by the condensed water in the external gas passage portion can be suppressed. Consequently, engine performance (fuel economy) can be increased while a reduction in engine quality is suppressed.

Furthermore, in the aforementioned air intake apparatus according to this aspect, the external gas passage portion, which is the structure separate from the air intake apparatus body, is provided inside the air intake apparatus body, whereby protrusion of the external gas passage portion outward of the air intake apparatus body can be suppressed, and hence the air intake apparatus can be downsized. Consequently, the air intake apparatus that suppresses a reduction in its mountability to the engine can be obtained.

In the aforementioned air intake apparatus according to this aspect, the external gas passage portion is preferably arranged apart from an inner surface of the intake air passage by a space inside the air intake apparatus body. According to this structure, the external gas passage portion can be thermally insulated from the inner surface of the intake air passage in the air intake apparatus body by the space. More specifically, the space serves as a heat-insulating layer.

Therefore, even if the air intake apparatus body is cooled by low-temperature outside air or low-temperature intake air that flows through the intake air passage, cooling of the external gas passage portion is effectively suppressed by the space serving as the heat-insulating layer, and hence the heat retaining property of the external gas passage portion can be effectively increased.

In the aforementioned air intake apparatus according to this aspect, the intake air passage preferably includes a plurality of intake air passages that distributes intake air to cylinders of an engine, respectively, and the external gas passage portion preferably has a tournament shape in which the external gas passage portion is hierarchically branched such that the external gas is guided to each of the plurality of intake air passages inside the air intake apparatus body. According to this structure, the external gas passage portion can be connected to each of the plurality of intake air passages while the flow path cross-sectional area of the external gas passage portion is reduced in stages, and hence the surface area of the external gas passage portion can be reduced as much as possible by this tournament shape. Therefore, a heat transfer area contacted by the external gas that flows through the external gas passage portion can be reduced as much as possible, and hence generation of the condensed water can be reduced. Furthermore, distributivity of the external gas can be ensured by the tournament shape.

In the aforementioned air intake apparatus according to this aspect, the external gas passage portion is preferably arranged inside the air intake apparatus body in a state where a plurality of members is combined with each other. According to this structure, even when the air intake apparatus body includes the intake air passage having a complicated shape with a bent portion (curved portion) or the like, the air intake apparatus can be formed by easily arranging the external gas passage portion separate in structure inside the air intake apparatus body without interfering with this intake air passage structure. Furthermore, the plurality of members are combined with each other, whereby the external gas passage portion having the tournament shape in which the external gas passage portion is hierarchically branched, for example, can be easily constructed.

In the aforementioned air intake apparatus according to this aspect, the external gas preferably includes exhaust gas recirculation gas for recirculating, to an engine, part of exhaust gas discharged from the engine. According to this structure, moisture contained in the exhaust gas recirculation gas can be inhibited from being cooled and condensed in the external gas passage portion, and hence occurrence of accidental fire in the combustion chamber can be suppressed. Furthermore, generation of a deposit caused by the condensed water in the external gas passage portion can be suppressed. Consequently, also in the engine that reduces a pumping loss (intake and exhaust loss) by taking in the exhaust gas recirculation gas to increase fuel economy, fuel economy can be increased while a reduction in engine quality is suppressed.

In the aforementioned structure in which the external gas passage portion has the tournament shape in which the external gas passage portion is hierarchically branched, an external gas introduction portion that introduces the external gas is preferably provided on one side end of the air intake apparatus body, and the external gas passage portion preferably extends inward of the air intake apparatus body through the external gas introduction portion, and has an asymmetrical tournament shape with respect to a starting point for branching to be hierarchically branched. According to this structure, even when the external gas is introduced from one side end of the air intake apparatus body into the external gas passage portion, flow path resistance can be substantially equalized by providing differences in length between a plurality of flow paths having the asymmetrical tournament shape, and hence the external gas can be distributed from downmost-stream inlets to the plurality of intake air passages, respectively, with the same gas flow amount (at the same gas flow rate).

In the aforementioned structure in which the external gas passage portion is arranged apart from the intake air passage by the space inside the air intake apparatus body, the air intake apparatus body is preferably constructed by bonding a first member, a second member, and an intermediate member arranged between the first member and the second member to each other in a state where the first member, the second member, and the intermediate member are stacked, the intake air passage is preferably formed in a region surrounded by the first member and the intermediate member, and the external gas passage portion is preferably arranged in a spatial region surrounded by the second member and the intermediate member. According to this structure, the external gas passage portion can be reliably thermally insulated from the inner surface of the intake air passage in the air intake apparatus body by the space.

Effect of the Invention

According to the present invention, as hereinabove described, the air intake apparatus capable of increasing engine performance (fuel economy) while suppressing a reduction in engine quality can be provided.

MODES FOR CARRYING OUT THE INVENTION

An embodiment of the present invention is hereinafter described on the basis of the drawings.

The structure of an air intake apparatus 100 according to the embodiment of the present invention is now described with reference to FIGS. 1 to 7. In the following description, it is assumed that each cylinder is arranged along an X-axis direction with respect to an engine 110. In addition, when the air intake apparatus 100 is viewed from the engine 110, an X1 side is set to a "left side", an X2 side is set to a "right side", and the up-down direction of the engine 110 is set to a Z-axis direction.

Figure 1:
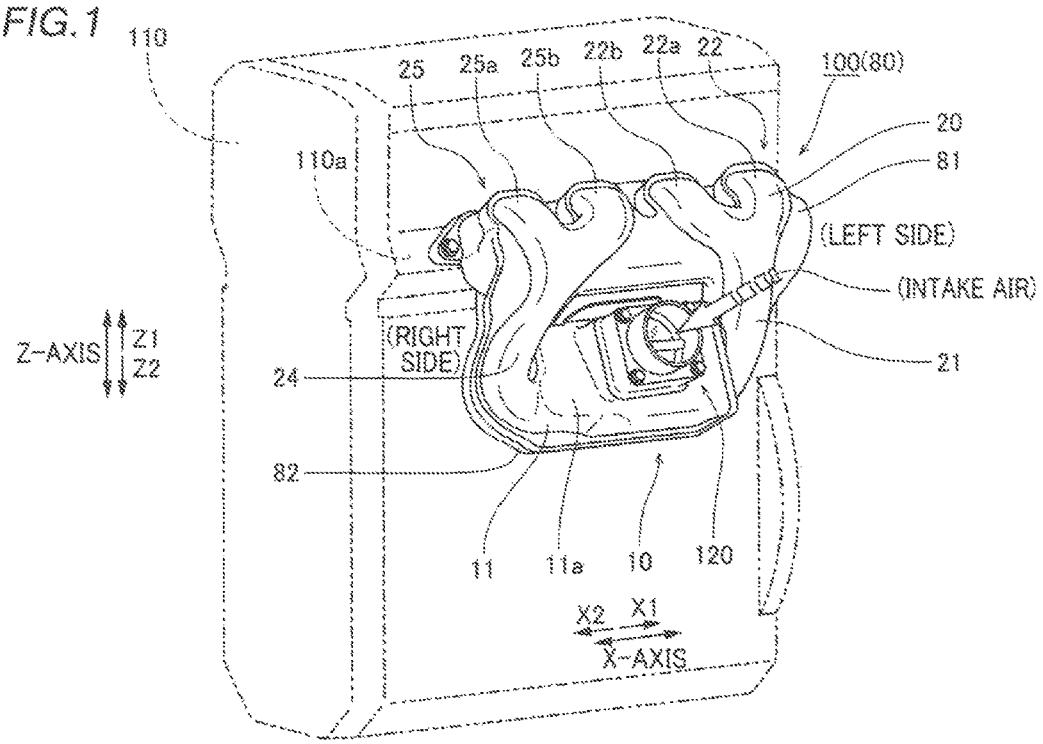
FIG. 1 A perspective view showing a state where an air intake apparatus according to an embodiment of the present invention is mounted on an engine.

The air intake apparatus 100 according to the embodiment of the present invention is mounted on the in-line four-cylinder engine 110 (the outer shape is shown by a one-dot chain line), as shown in FIG. 1. The air intake apparatus 100 constitutes a part of an air intake system that supplies air to the engine 110, and includes an air intake apparatus body 80 including a surge tank 10 and an air intake pipe portion 20 arranged downstream of the surge tank 10.

In the air intake apparatus 100, intake air that reaches an air intake 12*a* (see FIG. 2) through an air cleaner (not shown) and a throttle valve 120 serving as an intake air path flows into the surge tank 10. The air intake apparatus 100 is mounted on a side wall 110*a* of the engine 110 in a state where the throttle valve 120 is obliquely mounted on the air intake apparatus body 80 to be oriented downward from a horizontal position (a throttle body mounting portion 12 is oriented upward from a horizontal position).

EGR (exhaust gas recirculation) gas, which is part of exhaust gas discharged outward from a combustion chamber (cylinder (not shown)), is recirculated to the engine 110 through the air intake apparatus 100. Here, the EGR gas separate from the exhaust gas is cooled to a predetermined temperature (about 100° C.) and thereafter is introduced into the air intake apparatus body 80. The EGR gas contains moisture. The EGR gas is an example of "external gas" or "exhaust gas recirculation gas" in the present invention.

Figure 2:
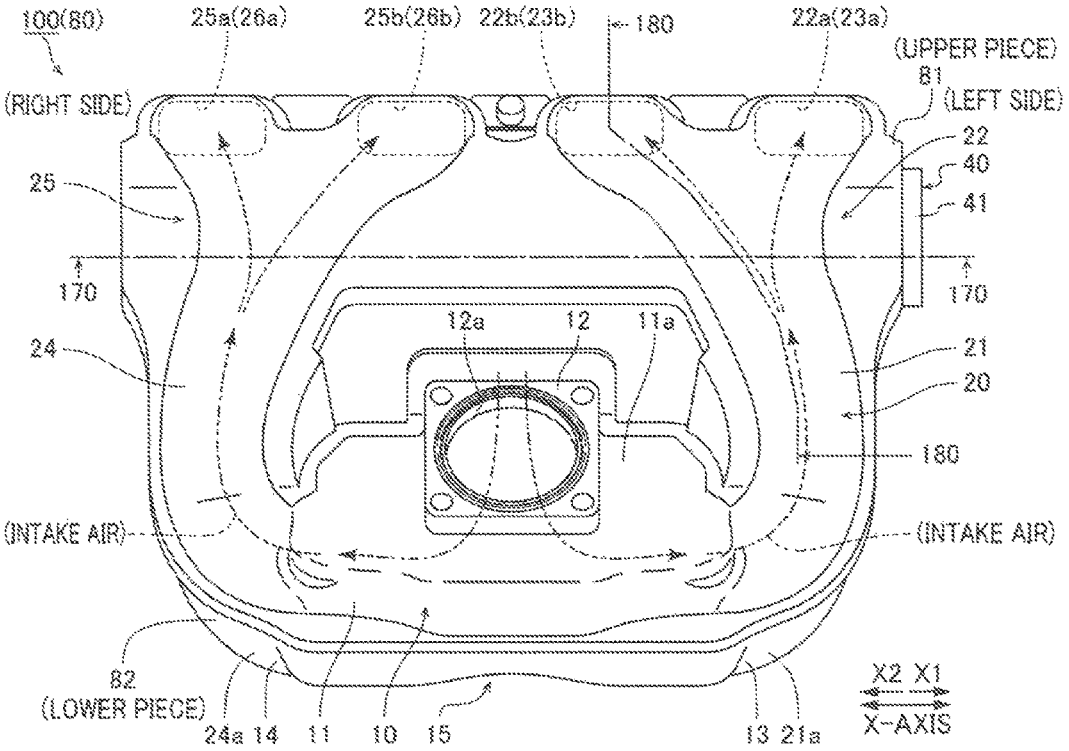
FIG. 2 A diagram showing the structure of the air intake apparatus according to the embodiment of the present invention.
Figure 3:
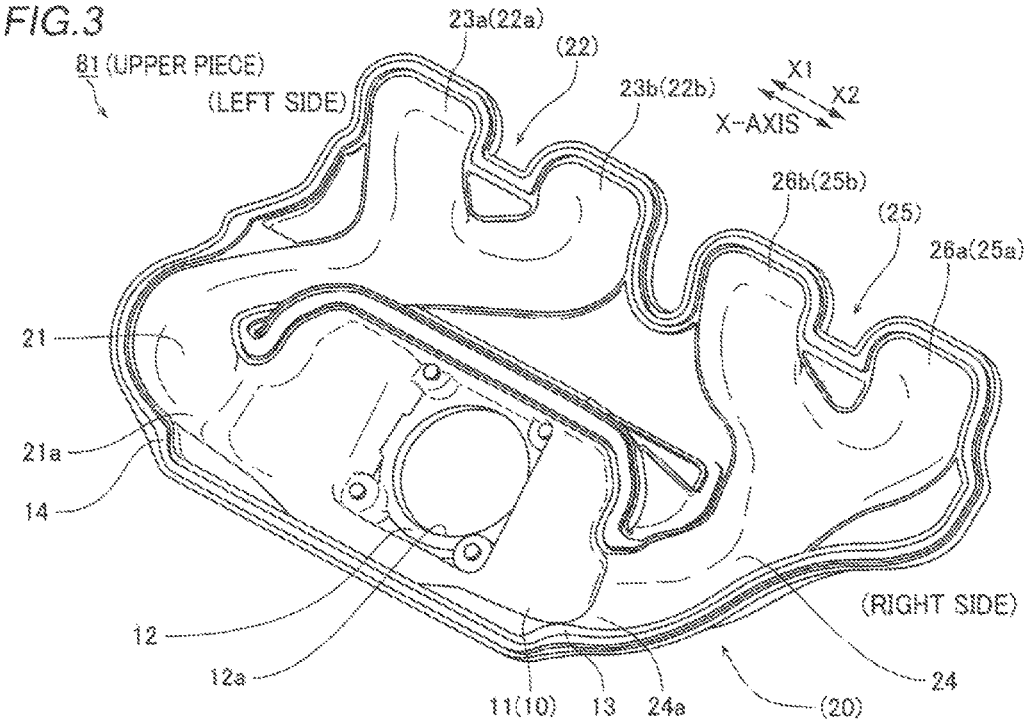
FIG. 3 A perspective view of an upper piece constituting an air intake apparatus body according to the embodiment of the present invention as viewed from the inner side thereof.
Figure 4:
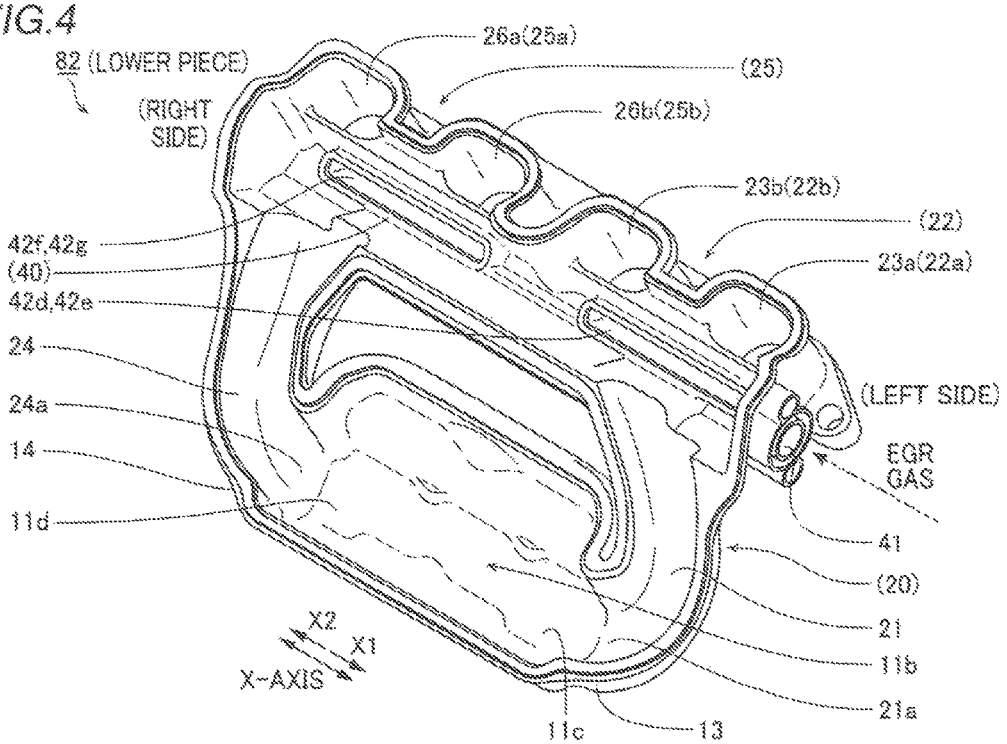
FIG. 4 A perspective view showing a lower piece constituting the air intake apparatus body according to the embodiment of the present invention as viewed from the inner side thereof.

As shown in FIG. 2, both the surge tank 10 and the air intake pipe portion 20 that constitute the air intake apparatus body 80 are made of resin (polyamide resin, for example). In the air intake apparatus body 80, an upper piece 81 (see FIG. 3) in which an upper half of the surge tank 10 and an upper half of the air intake pipe portion 20 are integrally molded and a lower piece 82 (see FIG. 3) in which a lower half of the surge tank 10 and a lower half of the air intake pipe portion 20 are integrally molded are integrally bonded to each other by vibration welding, as shown in FIGS. 3 and 4. The lower piece 82 integrally includes flow paths 42*d* to 42*g* (see FIG. 6) described later. The upper piece 81 and the lower piece 82 are examples of a "first member" and a "second member" in the present invention.

As shown in FIG. 2, the surge tank 10 includes a hollow body 11 that extends along a cylinder bank (X-axis) of the engine 110 (see FIG. 1). A left half (X1 side) of the air intake pipe portion 20 connected to the body 11 is constituted by a single left main pipe 21 and a left air intake pipe group 22 connected to the left main pipe 21. Similarly, a right half (X2 side) of the air intake pipe portion 20 is constituted by a single right main pipe 24 and a right air intake pipe group 25 connected to the right main pipe 24.

The left air intake pipe group 22 includes two air intake pipes 22*a* and 22*b* into which the left main pipe 21 is branched. Similarly, the right air intake pipe group 25 includes two air intake pipes 25*a* and 25*b* into which the right main pipe 24 is branched. The left air intake pipe group 22 and the right air intake pipe group 25 have a bilaterally symmetrical shape. The air intake pipes 22*a*, 22*b*, 25*a*, and 25*b* are examples of an "intake air passage" in the present invention.

Figure 6:
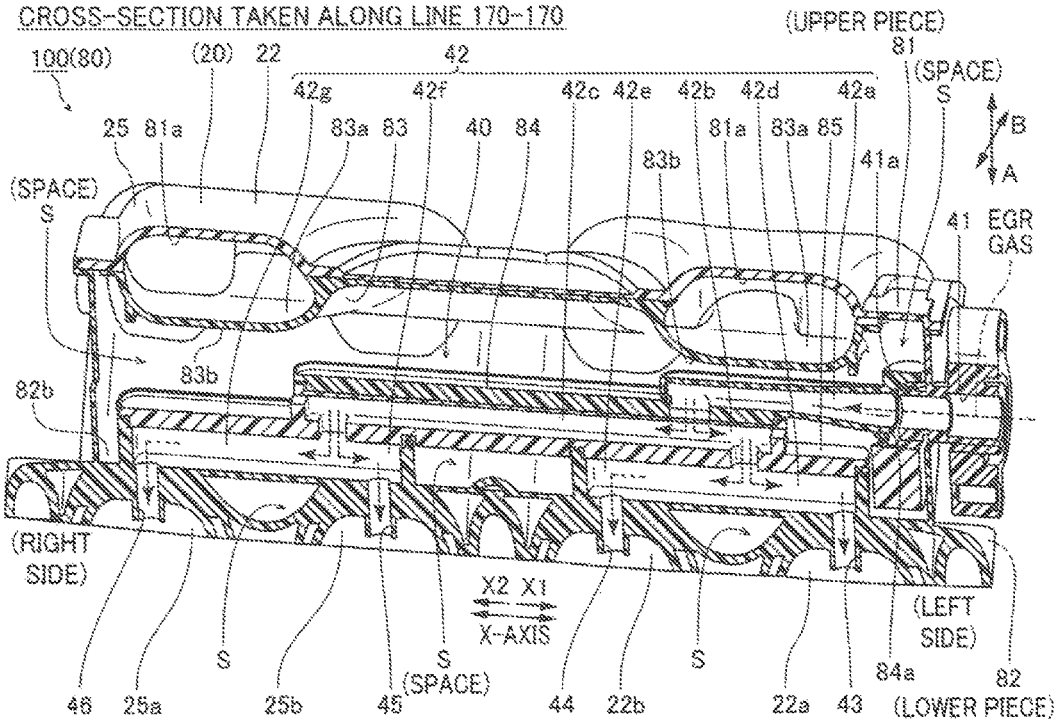
FIG. 6 A sectional view of the air intake apparatus body taken along the line 170-170 in FIG. 2.

According to this embodiment, the EGR gas is introduced into the engine 110, as described above. Specifically, an EGR gas passage portion 40 is provided inside the air intake apparatus body 80, as shown in FIG. 6. According to this embodiment, the EGR gas passage portion 40 is constructed as a member (structure) separate from the air intake apparatus body 80. The EGR gas passage portion 40 is an example of an "external gas passage portion" in the present invention. The structure of the EGR gas passage portion 40 is described below in detail.

The EGR gas passage portion 40 includes an EGR gas introduction portion 41 that is open outward (X1 side) and an EGR gas flow path 42 being connected to the EGR gas introduction portion 41, to which the EGR gas flows, and supplying (introducing) the EGR gas to each of the air intake pipes 22*a*, 22*b*, 25*a*, and 25*b*, as shown in FIG. 6. The EGR gas flow path 42 includes a single flow path 42*a* of a first hierarchy that extends from the EGR gas introduction portion 41, two flow paths 42*b* (X1 side) and 42*c* (X2 side) of a second hierarchy into which the flow path 42*a* is branched, two flow paths 42*d* (X1 side) and 42*e* (X2 side) of a third hierarchy into which the flow path 42*b* is branched, and two flow paths 42*f* (X1 side) and 42*g* (X2 side) of the third hierarchy into which the flow path 42*c* is branched.

The EGR gas flow path 42 further includes a tubular inlet 43 that connects the flow path 42*d* to the air intake pipe 22*a*, a tubular inlet 44 that connects the flow path 42*e* to the air intake pipe 22*b*, a tubular inlet 45 that connects the flow path 42*f* to the air intake pipe 25*b*, and a tubular inlet 46 that connects the flow path 42*g* to the air intake pipe 25*a*. The flow path cross-sectional areas of the flow paths 42*b* and 42*c* are relatively smaller than the flow path cross-sectional area of the flow path 42*a*, and the flow path cross-sectional areas of the flow paths 42*d* to 42*g* are relatively smaller than the flow path cross-sectional areas of the flow paths 42*b* and 42*c*. The flow path cross-sectional areas of the distal inlets 43 to 46 are minimized. Thus, the EGR gas passage portion 40 has a tournament shape in which the EGR gas flow path 42 is hierarchically branched. The EGR gas taken from the EGR gas introduction portion 41 sequentially flows through the EGR gas flow path 42 (the flow paths 42*a* to 42*g* and the inlets 43 to 46), and is introduced into each of the air intake pipes 22*a*, 22*b*, 25*b*, and 25*a*.

Figure 5:
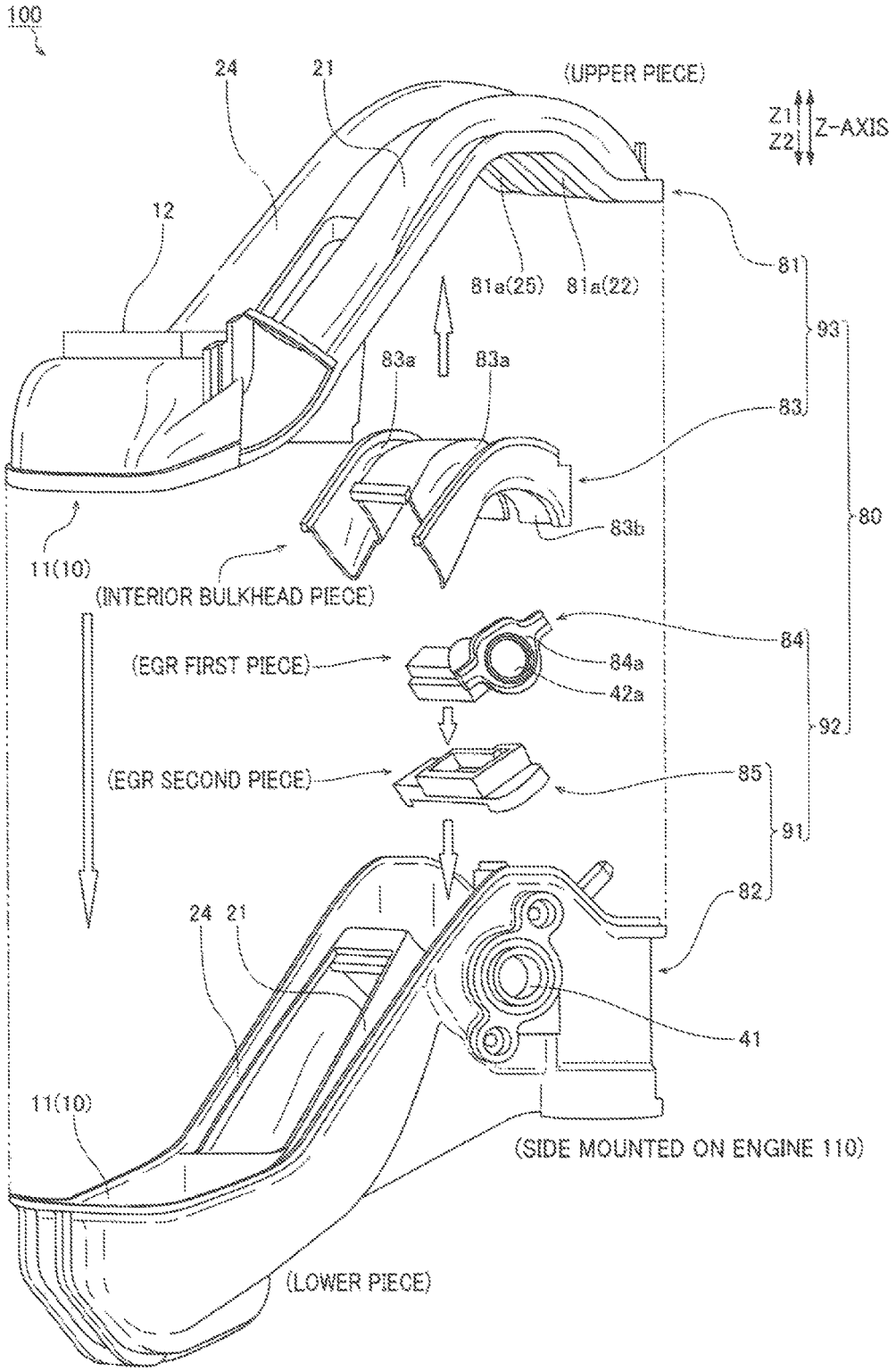
FIG. 5 An exploded perspective view showing the overall structure of the air intake apparatus according to the embodiment of the present invention.

As shown in FIG. 5, the air intake apparatus body 80 further includes an interior bulkhead piece 83 made of resin, an EGR first piece 84, and an EGR second piece 85 in addition to the upper piece 81 and the lower piece 82. The interior bulkhead piece 83 is an example of an "intermediate member" in the present invention.

Figure 7:
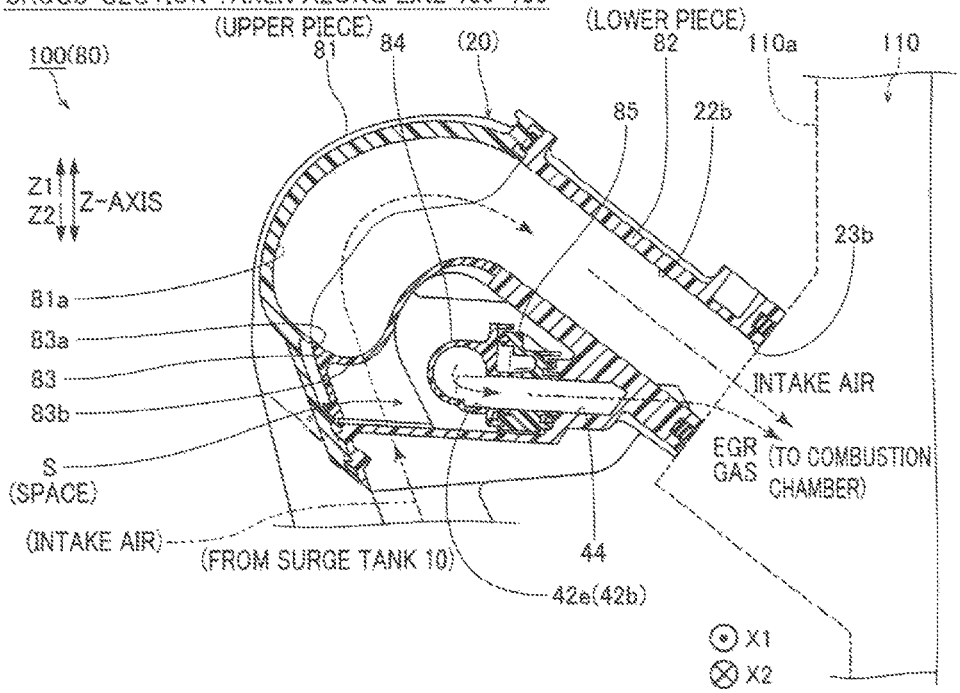
FIG. 7 A sectional view of the air intake apparatus body taken along the line 180-180 in FIG. 2.

The interior bulkhead piece 83 has a curved inner wall surface 83*a* (Z1 side) and a curved wall surface 83*b* (Z2 side), and is a component bonded to the upper piece 81 in a state where the interior bulkhead piece 83 faces the inner wall surface 81*a* of the upper piece 81 such that curved intake air passages can be formed. The EGR gas introduction portion 41 is integrally formed on a side portion of the lower piece 82 on the X1 side, as shown in FIGS. 5 and 6. As shown in FIGS. 6 and 7, the EGR second piece 85 has a shape that allows the EGR second piece 85 to be bonded to the inside of the lower piece 82, and the EGR first piece 84 has a shape that allows the EGR first piece 84 to be bonded to a portion of the EGR second piece 85 opposite to the lower piece 82 and a flanged inner portion 41*a* (a portion inside the air intake apparatus body 80; see FIG. 6) of the EGR gas introduction portion 41.

Thus, in the air intake apparatus 100, the EGR gas passage portion 40 is defined by a part of the lower piece 82, the EGR first piece 84, and the EGR second piece 85. In other words, the EGR gas passage portion 40 is arranged inside the air intake apparatus body 80 in a state where the lower piece 82, the EGR first piece 84, and the EGR second piece 85 as a plurality of (three) members are combined with each other. The lower piece 82, the EGR first piece 84, and the EGR second piece 85 are examples of a "plurality of members" in the present invention.

A process for manufacturing the air intake apparatus body 80 is now described. As shown in FIG. 5, the EGR second piece 85 is first bonded to the lower piece 82 by vibration welding. Then, the EGR first piece 84 is bonded, by vibration welding, to a structure 91 formed by integrating the lower piece 82 and the EGR second piece 85. Apart from the above, the interior bulkhead piece 83 is bonded to the upper piece 81 by vibration welding. Then, a structure 93 formed by integrating the upper piece 81 and the interior bulkhead piece 83 is bonded, by vibration welding, to a structure 92 formed by integrating the lower piece 82, the EGR second piece 85, and the EGR first piece 84. The air intake apparatus body 80 having the built-in EGR gas passage portion 40 is formed in this manner.

As shown in FIG. 6, the EGR second piece 85 faces the lower piece 82 (upper portions of the air intake pipes 22*a*, 22*b*, 25*a*, and 25*b*) in the up-down direction (arrow A direction) of the plane of the figure, and is bonded to the lower piece 82. The EGR first piece 84 faces the EGR second piece 85 in the up-down direction of the plane of the figure, and is bonded to the EGR second piece 85. In addition, a bonding portion 84*a* of the EGR first piece 84 faces the flanged inner portion 41*a* of the EGR gas introduction portion 41 in the lower piece 82 in the up-down direction (arrow A direction), left-right direction (X-axis direction), and depth direction (arrow B direction) of the plane of the figure, and is bonded to the flanged inner portion 41*a*.

Thus, according to this embodiment, the bonding portion 84*a* of the EGR first piece 84 and the inner portion 41*a* of the EGR gas introduction portion 41 are bonded to each other in the three directions (surface-to surface bonding at three positions), whereby the EGR first piece 84 is accurately aligned with respect to the EGR gas introduction portion 41. Thus, the EGR gas that flows through the EGR gas introduction portion 41 reliably flows to the downstream flow path 42*a*, and the EGR first piece 84 is steadied inside a space S while maintaining a state where the EGR first piece 84 and the air intake pipes 22*a*, 22*b*, 25*b*, and 25*a* sandwich the EGR second piece 85 therebetween.

As shown in FIG. 6, the interior bulkhead piece 83 is incorporated into positions corresponding to a portion of the upper piece 81 in which the left main pipe 21 is branched to the left air intake pipe group 22 and a portion of the upper piece 81 in which the right main pipe 24 is branched to the right air intake pipe group 25. The intake air passage inner surfaces of the portion in which the left main pipe 21 is branched to the left air intake pipe group 22 (air intake pipes 22*a* and 22*b*) and the portion in which the right main pipe 24 is branched to the right air intake pipe group 25 (air intake pipes 25*a* and 25*b*) are formed by the inner wall surface 81*a* of the upper piece 81 and the inner wall surface 83*a* of the interior bulkhead piece 83 that faces the inner wall surface 81*a*. The inner wall surface 81*a* of the upper piece 81 and the inner wall surface 83*a* of the interior bulkhead piece 83 are examples of an "inner surface of the intake air passage" in the present invention.

According to this embodiment, the EGR gas passage portion 40 is spaced apart from the upper piece 81 with the space S having a predetermined volume by the interior bulkhead piece 83 inside the air intake apparatus body 80, as shown in FIGS. 6 and 7. In other words, in a state where the interior bulkhead piece 83 is bonded to the upper piece 81, the space S is formed between the wall surface 83*b* of the interior bulkhead piece 83 opposite to the inner wall surface 83*a* and the outer wall surface 82*b* of the lower piece 82 that correspond to portions of the left air intake pipe group 22 and the right air intake pipe group 25.

The space S serves as a storage that stores the EGR gas passage portion 40, and has a three-dimensionally intricate shape. Thus, an inner surface (the inner surfaces of the air intake pipes 22*a*, 22*b*, 25*a*, and 25*b* (the inner wall surface 81*a* and the inner wall surface 83*a*)) along which the intake air flows in the lower piece 82 and the EGR gas passage portion 40 (EGR gas flow path 42) are prevented as much as possible through the intervention of the space S from directly contacting each other. Seen in this light, the EGR gas flow path 42 is in a bridged state inside the air intake apparatus body 80, using the space S as a heat-insulating layer.

In the above manufacturing process, the EGR second piece 85 and the EGR first piece 84 are combined with the lower piece 82, whereby the EGR gas passage portion 40 is formed. In this state, the structure 93 (see FIG. 5) formed by integrating the upper piece 81 and the interior bulkhead piece 83 is bonded to the structure 92 (see FIG. 5) by vibration welding, whereby the EGR gas passage portion 40 is surrounded by the space S (see FIG. 6).

The space S is filled with air, and serves as the heat-insulating layer. Therefore, the temperature of the upper piece 81, the interior bulkhead piece 83, and the lower piece 82 is not directly transmitted to the EGR gas passage portion 40 (the flow path 42*a*, the flow path 42*b*, and the flow path 42*c* in the EGR gas flow path 42). In other words, the EGR gas passage portion 40 is thermally insulated from the inner surface (the inner wall surface 81*a* and the inner wall surface 83*a*) of the air intake apparatus body 80 by the space S, and the heat of the intake air is prevented as much as possible from being transferred to the EGR gas passage portion 40. Therefore, even if the air intake apparatus body 80 is cooled by low-temperature outside air or the low-temperature intake air that flows through the air intake pipes 22*a*, 22*b*, 25*a*, and 25*b*, cooling of the EGR gas that flows through the EGR gas flow path 42 is effectively suppressed by the space S serving as the heat-insulating layer.

As shown in FIGS. 6 and 7, the lower piece 82 includes the aforementioned inlet 43 for the air intake pipe 22*a*, inlet 44 for the air intake pipe 22*b*, inlet 45 for the air intake pipe 25*b*, and inlet 46 for the air intake pipe 25*a*. Therefore, the EGR gas passage portion 40 surrounded by the space S physically contacts the intake air passages (air intake pipes 22*a*, 22*b*, 25*a*, and 25*b*) only through the inlets 43 to 46 at an end of the tournament shape.

As shown in FIG. 6, the tournament shape of the EGR gas passage portion 40 is bilaterally asymmetrical. Specifically, in the EGR gas flow path 42, a path length from the EGR gas introduction portion 41, which is open to the X1 side of the air intake apparatus body 80, to the inlet 45 or 46 arranged closer to the X2 side is relatively larger than a path length from the EGR gas introduction portion 41 to the inlet 43 or 44 arranged closer to the X1 side. Furthermore, in the second hierarchy, the length of the flow path 42*b* (X1 side) in the X-axis direction is shorter than the length of the flow path 42*c* (X2 side) in the X-axis direction. More specifically, the flow paths 42*b* and 42*c* are divergingly formed with asymmetrical lengths from a starting point from which the flow path 42*a* of the first hierarchy branches into flow paths 42*b* and 42*c*. In the third hierarchy, the length of the flow path 42*d* (X1 side) in the X-axis direction is shorter than the length of the flow path 42*e* (X2 side) in the X-axis direction. Similarly, in the third hierarchy, the length of the flow path 42*f* (X1 side) in the X-axis direction is shorter than the length of the flow path 42*g* (X2 side) in the X-axis direction. More specifically, the flow paths 42*d* and 42*e* are divergingly formed with asymmetrical lengths to right and left from a starting point from which the flow path 42*b* of the second hierarchy branches into flow paths 42*d* and 42*e*. Similarly, the flow paths 42*f* and 42*g* are divergingly formed with asymmetrical lengths to right and left from a starting point from which the flow path 42*c* of the second hierarchy branches into flow paths 42*f* and 42*g*.

In the air intake apparatus 100, these differences are provided in the path lengths of the flow paths formed by branching the single flow path 42 into four systems in order to equalize the flow rate (flow amount) of the EGR gas in the inlets 43 to 45 serving as final exits (inlets to the intake air passages) in a state where the EGR gas introduction portion 41 is provided on one side (X1 side) of the air intake apparatus body 80. The EGR gas flows through the upmost-stream flow path 42*a* in an arrow X2 direction, and hence the EGR gas tends to relatively easily flow through the flow paths 42*c*, 42*e*, and 42*g* that extend in the arrow X2 direction as compared with the flow paths 42*b*, 42*d*, and 42*f* that extend in an arrow X1 direction. Therefore, the flow paths 42*c*, 42*e*, and 42*g* that extend in the arrow X2 direction are increased in length to obtain flow path resistance. In contrast, the flow paths 42*b*, 42*d*, and 42*f* are decreased in length to reduce flow path resistance. Thus, the EGR gas, which is introduced from one side of the air intake apparatus body 80 and flows through the flow path 42*a* in the arrow X2 direction, is distributed to each of the air intake pipes 22*a*, 22*b*, 25*a*, and 25*b* through the downmost-stream inlets 43 to 46 with the same gas flow amount.

As shown in FIG. 2, the surge tank 10 is provided with the throttle body mounting portion 12 including the air intake 12*a* on the upper surface 11*a* side (a surface visible at the front side of the plane of the figure) of a central portion of the surge tank 10 in a direction (left-right direction: X-axis direction) in which the body 11 extends. In the air intake apparatus 100, the single left main pipe 21 is connected to a left end 13 (X1 side) of the surge tank 10 in the direction in which the body 11 extends, and the single right main pipe 24 is connected to a right end 14 (X2 side) of the surge tank 10 in the direction in which the body 11 extends. In this case, an intake air path length from the air intake 12*a* of the surge tank 10 to a connection (end 21*a*) of the left main pipe 21 and an intake air path length from the air intake 12*a* of the surge tank 10 to a connection (end 24*a*) of the right main pipe 24 are equal to each other. Furthermore, the left main pipe 21 is branched into the air intake pipes 22*a* and 22*b* on the side (a downstream side in a direction of intake air flow) opposite to the side (end 21*a* side) of the left main pipe 21 connected to the body 11. Similarly, the right main pipe 24 is branched into the air intake pipes 25*a* and 25*b* on the side (the downstream side in the direction of intake air flow) opposite to the side (end 24*a* side) of the right main pipe 24 connected to the body 11.

Therefore, inside the body 11, approximately half of the intake air taken into the surge tank 10 through the air intake 12*a* is distributed in a left direction (X1 side), and the remaining approximately half of the intake air is distributed in a right direction (X2 side). Then, the approximately half of the intake air is guided from the left end 13 to the left main pipe 21, and the remaining approximately half of the intake air is guided from the right end 14 to the right main pipe 24. Then, the intake air is further distributed to the air intake pipes 22*a* and 22*b* on the downstream side of the left main pipe 21 and further distributed to the air intake pipes 25*a* and 25*b* on the downstream side of the right main pipe 24.

As shown in FIG. 2, an air intake pipe length from the end 21*a* of the left main pipe 21 closer to the surge tank 10 to each of tip ends 23*a* and 23*b* of the air intake pipes 22*a* and 22*b* in the left air intake pipe group 22 is equal to an air intake pipe length from the end 24*a* of the right main pipe 24 closer to the surge tank 10 to each of tip ends 26*a* and 26*b* of the air intake pipes 25*a* and 25*b* in the right air intake pipe group 25.

In other words, an intake air path length from the end 21*a* of the left main pipe 21 that corresponds to a left exit of the surge tank 10 to the tip end 23*a* of the air intake pipe 22*a* branched toward a corresponding cylinder of the engine 110 (see FIG. 1) and an intake air path length from the end 21*a* of the left main pipe 21 to the tip end 23*b* of the air intake pipe 22*b* are equal to each other. An intake air path length from the end 24*a* of the right main pipe 24 that corresponds to a right exit of the surge tank 10 to the tip end 26*a* of the air intake pipe 25*a* branched toward a corresponding cylinder of the engine 110 (see FIG. 1) and an intake air path length from the end 24*a* of the right main pipe 24 to the tip end 26*b* of the air intake pipe 25*b* are equal to each other. The air intake pipe portion 20 is configured such that these four intake air path lengths are equal to each other.

Thus, the air intake apparatus body 80 is configured to take in intake air from the central portion of the surge tank 10 and guide, with the same flow amount (with one fourth), the intake air to the four air intake pipes 22*a*, 22*b*, 25*a*, and 25*b* through the single left main pipe 21 and the single right main pipe 24 connected to the left and right ends of the surge tank 10, as shown in FIG. 1.

In the surge tank 10, the inner surface of the body 11 is concavo-convex. Specifically, a convex portion 15 that is raised in an arrow Z1 direction is provided inside the surge tank 10, as shown in FIG. 2. Thus, an inner bottom surface lib (see FIG. 4) that corresponds to a central portion of the body 11 formed with the throttle body mounting portion 12 protrudes inward of the surge tank 10 with respect to the inner bottom surface 11*c* of the left end 13 and the inner bottom surface 11*d* of the right end 14 of the surge tank 10 in the left-right direction. The end 21*a* of the left main pipe 21 connected to the surge tank 10 is provided in the vicinity of the lowermost portion of the left end 13, and the end 24*a* of the right main pipe 24 connected to the surge tank 10 is provided in the vicinity of the lowermost portion of the right end 14.

As shown in FIGS. 1 and 2, the tip end 23*a* of the air intake pipe 22*a*, the tip end 23*b* of the air intake pipe 22*b*, the tip end 26*a* of the air intake pipe 25*a*, and the tip end 26*b* of the air intake pipe 25*b* that constitute the air intake pipe portion 20 are linearly arranged along the direction (X-axis direction) in which the body 11 of the surge tank 10 extends. The air intake apparatus 100 according to this embodiment is configured in the above manner.

According to this embodiment, the following effects can be obtained.

According to this embodiment, as hereinabove described, the EGR gas passage portion 40 provided as a structure separate from the air intake apparatus body 80, through which the EGR gas can be introduced into the air intake pipes 22*a*, 22*b*, 25*a*, and 25*b* is provided inside the air intake apparatus body 80. Thus, the EGR gas passage portion 40 is included in (built into) the air intake apparatus body 80 in a state where the EGR gas passage portion 40 is a separate member from the air intake apparatus body 80, and hence the EGR gas that flows through the EGR gas passage portion 40 is inhibited by both the EGR gas passage portion 40 and the air intake apparatus body 80 outside the EGR gas passage portion 40 from being directly influenced by the outside air (outside air temperature). Therefore, even when the engine 110 is operated under conditions of low outside air temperature (below freezing), the heat retaining property of the EGR gas passage portion 40 is increased, and hence cooling of the warm EGR gas in the EGR gas passage portion 40 is suppressed. In other words, moisture contained in the EGR gas for recirculating part of the exhaust gas discharged from the engine 110 to the engine 110 can be inhibited from being cooled and condensed in the EGR gas passage portion 40, and hence occurrence of accidental fire in the combustion chamber can be suppressed. Furthermore, generation of a deposit caused by the condensed water in the EGR gas passage portion 40 can be suppressed. Consequently, also in the engine 110 that reduces a pumping loss (intake and exhaust loss) by taking in the EGR gas to increase fuel economy, fuel economy can be increased while a reduction in the quality of the engine 110 is suppressed.

According to this embodiment, the EGR gas passage portion 40, which is the structure separate from the air intake apparatus body 80, is provided inside the air intake apparatus body 80, whereby protrusion of the EGR gas passage portion 40 outward of the air intake apparatus body 80 can be suppressed, and hence the air intake apparatus 100 can be downsized. Consequently, the air intake apparatus 100 that suppresses a reduction in its mountability to the engine 110 can be obtained.

According to this embodiment, the EGR gas passage portion 40 is arranged apart from the inner surfaces (the inner wall surface 81*a* and the inner wall surface 83*a*) of the air intake pipes 22*a*, 22*b*, 25*a*, and 25*b* by the space S inside the air intake apparatus body 80. Thus, the EGR gas passage portion 40 can be thermally insulated from the inner surfaces (the inner wall surface 81*a* and the inner wall surface 83*a*) of the air intake pipes 22*a*, 22*b*, 25*a*, and 25*b* in the air intake apparatus body 80 by the space S. More specifically, the space S serves as the heat-insulating layer. Therefore, even if the air intake apparatus body 80 is cooled by the low-temperature outside air or the low-temperature intake air that flows through the air intake pipes 22*a*, 22*b*, 25*a*, and 25*b*, cooling of the EGR gas passage portion 40 is effectively suppressed by the space S serving as the heat-insulating layer, and hence the heat retaining property of the EGR gas passage portion 40 can be effectively increased.

According to this embodiment, the four air intake pipes 22*a*, 22*b*, 25*a*, and 25*b* that distribute the intake air to cylinders of the engine 110, respectively, are provided in the air intake pipe portion 20. Furthermore, in the air intake apparatus 100, the EGR gas passage portion 40 has the tournament shape in which the EGR gas passage portion 40 is hierarchically branched such that the EGR gas is guided to each of a plurality of air intake pipes 22*a*, 22*b*, 25*a*, and 25*b* inside the air intake apparatus body 80. Thus, the EGR gas passage portion 40 can be connected to each of the plurality of air intake pipes 22*a*, 22*b*, 25*a*, and 25*b* while the flow path cross-sectional area of the EGR gas passage portion 40 is reduced in stages, and hence the surface area of the EGR gas passage portion 40 can be reduced as much as possible by this tournament shape. Therefore, a heat transfer area contacted by the EGR gas that flows through the EGR gas passage portion 40 can be reduced as much as possible, and hence generation of the condensed water can be reduced. Furthermore, distributivity of the EGR gas can be ensured by the tournament shape.

According to this embodiment, the air intake apparatus 100 includes the EGR gas passage portion 40 arranged inside the air intake apparatus body 80 in a state where the lower piece 82, the EGR first piece 84, and the EGR second piece 85 are combined with each other. Thus, even when the air intake apparatus body 80 includes the air intake pipes 22*a*, 22*b*, 25*a*, and 25*b* having complicated shapes with bent portions (curved portions) or the like, the air intake apparatus 100 can be formed by easily arranging the EGR gas passage portion 40 separate in structure inside the air intake apparatus body 80 without interfering with this intake air passage structure. Furthermore, the above three members are combined with each other, whereby the EGR gas passage portion 40 having the tournament shape in which the EGR gas passage portion 40 is hierarchically branched can be easily constructed.

According to this embodiment, the EGR gas passage portion 40 that has the asymmetrical tournament shape with respect to the starting point for branching to be hierarchically branched is provided. Thus, even when the EGR gas is introduced from an end of the air intake apparatus body 80 on the X1 side into the EGR gas passage portion 40, flow path resistance can be substantially equalized by providing differences in length between the four flow paths having the asymmetrical tournament shape, and hence the EGR gas can be distributed from the downmost-stream inlets 43 to 46 to each of the air intake pipes 22*a*, 22*b*, 25*a*, and 25*b* with the same gas flow amount and at the same gas flow rate.

According to this embodiment, the air intake pipes 22*a*, 22*b*, 25*a*, and 25*b* are formed in a region surrounded by the upper piece 81 and the interior bulkhead piece 83, and the EGR gas passage portion 40 is arranged in the space S surrounded by the lower piece 82 and the interior bulkhead piece 83. Thus, the EGR gas passage portion 40 can be reliably thermally insulated from the inner wall surface 81*a* and the inner wall surface 83*a* of the air intake pipes 22*a*, 22*b*, 25*a*, and 25*b* in the air intake apparatus body 80 by the space S.

The embodiment disclosed this time must be considered as illustrative in all points and not restrictive. The range of the present invention is shown not by the above description of the embodiment but by the scope of claims for patent, and all modifications within the meaning and range equivalent to the scope of claims for patent are further included.

For example, while the present invention is applied to the air intake apparatus 100 mounted on the in-line four-cylinder engine 110 in the aforementioned embodiment, the present invention is not restricted to this. In other words, the air intake apparatus according to the present invention may be mounted on an in-line multi-cylinder engine other than the in-line four-cylinder engine or may be mounted on a V-type multi-cylinder engine, a horizontal opposed engine, or the like. As the engine, a gasoline engine, a diesel engine, a gas engine, or the like is applicable. Alternatively, the present invention is also applicable to an air intake apparatus mounted on an internal-combustion engine or the like placed on transportation equipment such as a train or a marine vessel or stationary equipment other than the transportation equipment in addition to the engine (internal-combustion engine) mounted on a common vehicle (motor vehicle).

While the space S that surrounds the EGR gas passage portion 40 is filled with air in the aforementioned embodiment, the present invention is not restricted to this. The space S may be filled with a filler having a heat insulating property, for example. The space S may be filled with a foam insulation such as urethane resin as the filler. Alternatively, the space S may be filled with not only the foam insulation but also a fiber insulation such as glass wool. In this case, the upper piece 81 to which the interior bulkhead piece 83 is bonded may be bonded to the lower piece 82 in a state where the EGR gas passage portion 40 is enclosed (covered) by the foam insulation or the fiber insulation. In addition, an air layer (heat-insulating layer) may be further provided in a clearance between the EGR gas passage portion 40 covered by a covering layer (heat-insulating layer) such as the foam insulation or the fiber insulation and the interior bulkhead piece 83.

While the EGR gas passage portion 40 is formed by bonding the lower piece 82, the EGR first piece 84, and the EGR second piece 85 to each other in the aforementioned embodiment, the present invention is not restricted to this. In other words, the EGR gas passage portion 40 may be formed by combining two members, or the EGR gas passage portion 40 may be formed by combining four or more members.

While the EGR gas (exhaust gas recirculation gas) is introduced into each of the air intake pipes 22*a*, 22*b*, 25*a*, and 25*b* in the aforementioned embodiment, the present invention is not restricted to this. The "external gas passage portion" according to the present invention is also applicable to a structure in which blow-by gas (PCV gas) for ventilating a crank chamber is introduced as the "external gas" according to the present invention into each of the air intake pipes 22*a*, 22*b*, 25*a*, and 25*b*, for example. In other words, moisture or the like contained in the blow-by gas (unburned gas mixture) can be inhibited from being cooled and condensed in the external gas passage portion, and occurrence of accidental fire in the combustion chamber can be suppressed. Furthermore, generation of a deposit caused by the condensed water in the external gas passage portion can be suppressed. Consequently, engine performance (fuel economy) can be increased while a reduction in engine quality is suppressed.

While the EGR gas passage portion 40 has the bilaterally asymmetrical tournament shape in the aforementioned embodiment, the present invention is not restricted to this. The "external gas passage portion" may be configured such that downstream distribution flow paths have a bilaterally symmetrical tournament shape by constructing the EGR gas passage portion including the EGR gas introduction portion 41 formed at a central portion of the air intake apparatus.

While the EGR gas passage portion 40 is configured to distribute the EGR gas to each of the air intake pipes 22*a*, 22*b*, 25*a*, and 25*b* in the aforementioned embodiment, the present invention is not restricted to this. Even when the EGR gas is introduced into the surge tank 10 inside the air intake apparatus body 80, for example, the "external gas passage portion" according to the present invention separate in structure from the air intake apparatus body 80 may be internally provided. In this case, the EGR gas may be introduced into the surge tank 10 through a single inlet or a plurality of inlets.

While both the air intake apparatus body 80 and the EGR gas passage portion 40 are made of resin (polyamide resin) in the aforementioned embodiment, the present invention is not restricted to this. In other words, the air intake apparatus body 80 and the EGR gas passage portion 40 may be made of metal so far as the EGR gas passage portion 40 is provided as a structure (member) separate from the air intake apparatus body 80 inside the air intake apparatus body 80.

DESCRIPTION OF REFERENCE SIGNS

20 air intake pipe portion
22*a*, 22*b*, 25*a*, 25*b* air intake pipe (intake air passage)
40 EGR gas passage portion (external gas passage portion)
41 EGR gas introduction portion
41*a* inner portion
42 EGR gas flow path
42*a*, 42*b*, 42*c*, 42*d*, 42*e*, 42*f*, 42*g* path
43, 44, 45, 46 inlet
80 air intake apparatus body
81 upper piece (first member)
82 lower piece (plurality of members, second member)
83 interior bulkhead piece (intermediate member)
84 EGR first piece (plurality of members)
84*a* bonding portion
85 EGR second piece (plurality of members)
91, 92, 93 structure
100 air intake apparatus
110 engine

The invention claimed is:

1. An air intake apparatus comprising:

an air intake apparatus body including an intake air passage; and an external gas passage portion provided as a structure separate from the air intake apparatus body inside the air intake apparatus body, the external gas passage portion through which an external gas can be introduced into the intake air passage, wherein the external gas passage portion is arranged apart from an inner surface of the intake air passage by a heat-insulating layer inside the air intake apparatus body, the intake air passage includes a plurality of intake air passages that distribute intake air to cylinders of an engine, respectively, the external gas passage portion has a shape in which the external gas passage portion is hierarchically branched such that the external gas is guided to each of the plurality of intake air passages inside the air intake apparatus body, a single external gas introduction portion that introduces the external gas is provided on one side end of the air intake apparatus body, the external gas passage portion extends inward of the air intake apparatus body through the single external gas introduction portion, and has an asymmetrical shape with respect to a starting point for branching to be hierarchically branched, the external gas passage portion includes a single first external gas passage portion connected to the single external gas introduction portion, a plurality of second external gas passage portions branching from the single first external gas passage portion, and a plurality of third external gas passage portions branching from each of the plurality of second external gas passage portions in the same number as the plurality of intake air passages, and the plurality of third external gas passage portions connect to the plurality of intake air passages.

2. The air intake apparatus according to claim 1, wherein the air intake apparatus body is constructed by bonding a first member, a second member, and an intermediate member arranged between the first member and the second member to each other in a state where the first member, the second member, and the intermediate member are stacked, and the intake air passage is formed in a region surrounded by the first member and the intermediate member, and the external gas passage portion is arranged in a spatial region surrounded by the second member and the intermediate member.

3. The air intake apparatus according to claim 1, wherein the external gas passage portion has a plurality of members combined with each other.

4. The air intake apparatus according to claim 1, wherein the external gas includes exhaust gas recirculation gas for recirculating, to an engine, part of exhaust gas discharged from the engine.

* * * * *